US006394795B2

(12) United States Patent
Fayerman et al.

(10) Patent No.: US 6,394,795 B2
(45) Date of Patent: May 28, 2002

(54) AIR HEATING BURNER

(75) Inventors: Matvey Fayerman; Ad de Pijper; David Collier, all of Rockford, IL (US)

(73) Assignee: Eclipse, Inc., Rockford, IL (US)

( * ) Notice: Subject to any disclaimer, the term of this patent is extended or adjusted under 35 U.S.C. 154(b) by 0 days.

(21) Appl. No.: 09/925,591

(22) Filed: Aug. 9, 2001

Related U.S. Application Data

(63) Continuation of application No. 09/512,718, filed on Feb. 24, 2000.
(60) Provisional application No. 60/124,031, filed on Mar. 11, 1999.

(51) Int. Cl.[7] ..... F23D 14/66
(52) U.S. Cl. ..... 432/222; 431/351; 431/352
(58) Field of Search ..... 432/222; 431/352, 431/351, 10

(56) References Cited

U.S. PATENT DOCUMENTS

| | | | | |
|---|---|---|---|---|
| 2,654,219 A | | 10/1953 | Zaba | 60/39.65 |
| 3,051,464 A | | 8/1962 | Yeo et al. | |
| 3,178,161 A | * | 4/1965 | Yeo et al. | 432/222 |
| 4,311,451 A | * | 1/1982 | Matsumoto et al. | 431/352 |
| 4,488,868 A | * | 12/1984 | Tanaka | 431/243 |
| 4,573,907 A | | 3/1986 | Coppin et al. | 431/351 |
| 4,869,665 A | | 9/1989 | Coppin | 431/351 |
| 4,929,541 A | | 5/1990 | Potter et al. | 432/222 |
| 4,993,944 A | | 2/1991 | Potter et al. | 432/222 |
| 5,131,836 A | | 7/1992 | Coppin | 431/12 |

* cited by examiner

*Primary Examiner*—Jiping Lu
(74) *Attorney, Agent, or Firm*—Leydig, Voit & Mayer, LTD

(57) ABSTRACT

An air heating burner having improved CO emissions across a broad range of heat inputs. The burner incorporates wings which cover portions of mixing plates associated with low to medium-low fire. The wings reduce air flow velocity to eliminate quenching during such conditions, thereby increasing combustion temperature and reducing CO emissions. The wings also form pre-heat chambers which further increase combustion temperature. The burner produces a substantially consistent level of CO emissions across the range of inputs, regardless of the pressure drop across the burner.

23 Claims, 5 Drawing Sheets

AIR HEATING BURNER

CROSS-REFERENCE TO RELATED PATENT APPLICATIONS

This patent application is a continuation of copending U.S. patent application Ser. No. 09/512,718, filed Feb. 24, 2000, which claims the benefit of U.S. provisional patent application Serial No. 60/124,031 filed Mar. 11, 1999.

FIELD OF THE INVENTION

The present invention generally relates to burners, and more particularly relates to burners for use in air heating applications.

BACKGROUND OF THE INVENTION

Burners for heating air typically comprise a fuel manifold having a plurality of linearly aligned fuel discharge ports. A pair of mixing plates or wings are attached to the manifold and have combustion air ports extending therethrough to produce jets of air which mix with fuel exiting the discharge ports to create a combustible mixture. In most air heating burners, the mixing plates generally diverge from one another in the downstream direction to form a V-shape.

It is important for such burners to have a wide turndown range to provide varying heat outputs to the process. It will be appreciated that as fuel flow is adjusted along the turndown range, the velocity of fuel flow through the discharge ports changes in a corresponding fashion. At low fire, for example, the fuel has a relatively low velocity. As such, air from only the upstream ports of the plates mixes with the fuel to produce a combustible mixture. As the firing rate increases, the fuel velocity similarly increases to project fuel further downstream between the plates. As a result, air from further downstream ports mixes with the fuel to increase the amount of combustible mixture. Mixture of fuel and air begins immediately at each combustion air port to produce localized combustion adjacent the air port.

It is particularly important for air heaters to minimize the level of CO emissions generated during operation. When air is supplied at a constant volume, as is conventional and most cost effective (because no combustion air flow controls are required), the above-described conventional burners fail to meet acceptable emission levels over the entire range of inputs. At high fire, conventional air heaters are designed to have approximately ten to fifty percent (10–50%) excess air, resulting in substantially complete combustion and acceptable CO emissions of less than about 400 ppm. Due to the fixed volume of air, however, the proportion of excess air becomes extremely high for low to medium-low inputs. Combustion at these levels is often quenched by the high amount of excess air, leading to a lower combustion temperature, incomplete combustion, and unacceptably high CO levels of 1000 ppm or more.

In the past, others have attempted to address this problem by optimizing combustion air port size and location. Such optimization may lower CO emissions at medium to high fire, but CO levels at lower inputs are still unsatisfactory. The CO emission profile across a range of inputs follows the same pattern, in which the highest CO emissions are seen at lower inputs. Furthermore, conventional burners produce widely varying CO emissions according to the magnitude of the pressure drop across the burner. In general, previous burners tend to generate lower CO emissions with smaller pressure drops, while greater pressure drops are often associated with higher CO levels.

BRIEF SUMMARY OF THE INVENTION

A general object of the present invention is to provide an air heating burner which produces relatively low CO emissions over an entire range of inputs.

A related object of the present invention is to provide an air heating burner which minimizes CO emissions during low to medium-low fire.

In that regard, it is an object of the present invention to provide an air heating burner that eliminates quenching of combustion by excess air during low to medium-low fire conditions.

It is also an object of the present invention to provide an air heating burner having consistently low CO emissions regardless of the magnitude of the pressure drop across the burner and thereby air flow velocity through the ports of the mixing plates.

An additional object of the present invention is to provide an air heating burner having more uniform combustion air flow distribution.

Yet another object of the present invention is to provide an air heating burner which pre-heats combustion air to increase overall combustion temperature, thereby reducing CO emissions.

Still another object of the present invention is to provide an air heating burner which reduces flame length at high fire.

In light of the above, an air heating burner is provided which reduces combustion air velocity in the region of the burner associated with low to medium-low fire. The burner assembly includes a fuel manifold having mixing plates attached thereto and disposed downstream of the manifold. The mixing plates diverge from one another in a downstream direction to form a general V-shape when viewed from above. A plurality of combustion air ports extends through the mixing plates to provide jets of air for mixing with fuel from the manifold. In the currently preferred embodiment, the burner assembly includes a pair of wings located upstream of and overlapping portions of associated mixing plates. The wings cover the upstream (or lower) portion of the mixing plates, which carry the combustion air ports associated with low to medium-low fire. Air flow ports in the wings provide an additional pressure drop which decreases air flow velocity at the mixing plates. The wings do not cover the combustion air ports associated with medium to high fire. The lower air flow velocity through the low and medium-low air ports reduces quenching, thereby minimizing CO emissions. The wings also ensure that fuel flow velocity is greater than air flow velocity over a larger operating range, thereby maximizing the turndown of the burner. Each wing with its associated mixing plate also forms a pre-heat chamber for the incoming combustion air. As a result, the temperature of combustion is increased, which also serves to minimize CO emissions.

The burner is also configured to reduce flame length at high fire. The extreme downstream portion of each mixing plate extends directly downstream so that the mixing plates are parallel to one another in this area. These areas of the mixing plates carry combustion air ports associated with high fire. The parallel mixing plate portions serve to reduce flame length during high fire, thereby reducing space requirements for the burner application. The parallel portions also create more intense mixing of air with fuel and combustion products, thereby creating more complete combustion and reducing CO emissions.

These and other aims, objectives, and features of the invention will become more apparent from the following detailed description when taken in conjunction with the accompanying drawings.

Figure 1:
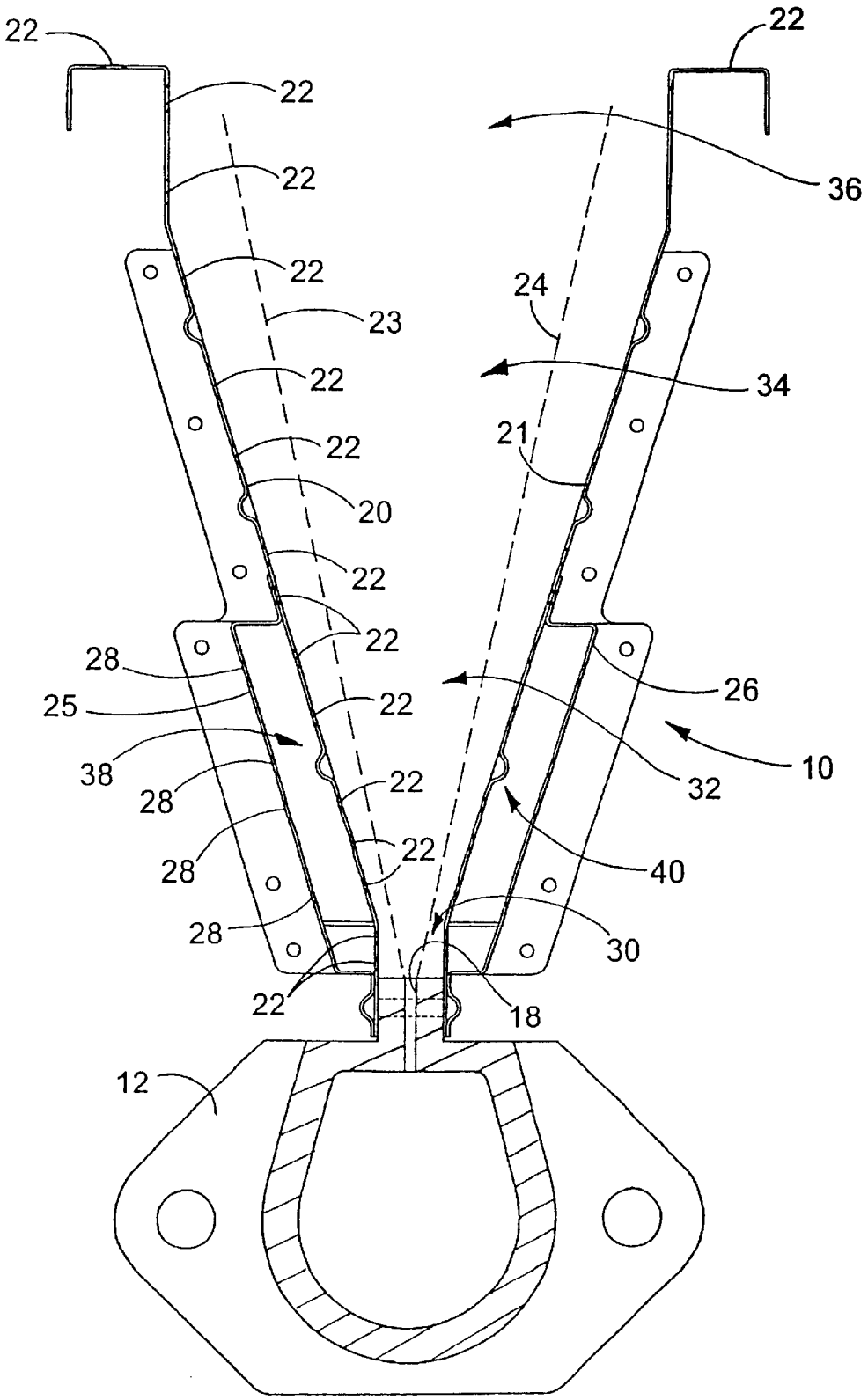
FIG. 1 is a cross-sectional view of an air heating burner in accordance with the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE INVENTION

Figure 4:
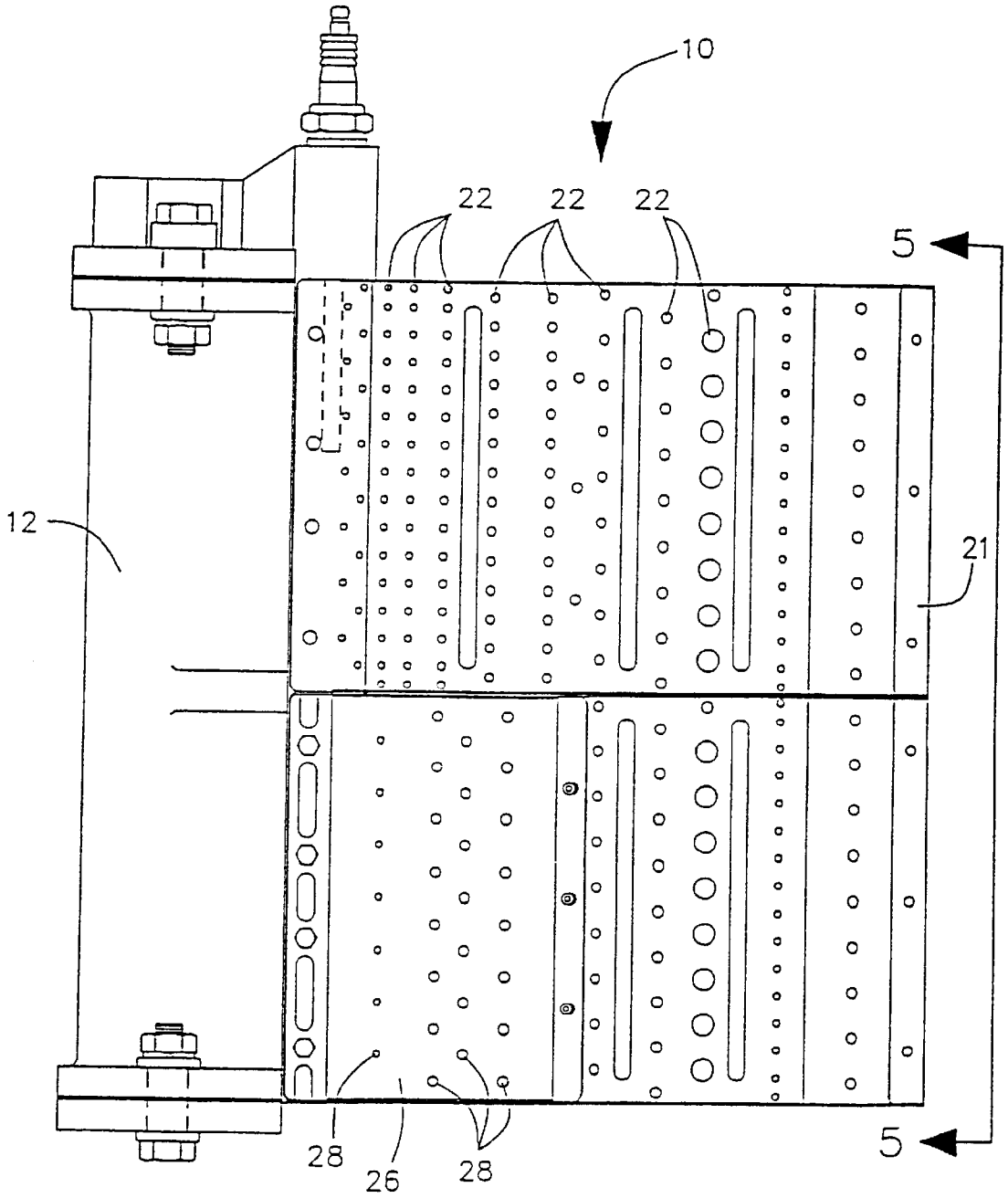
FIG. 4 is a side elevational view of the burner of FIG. 1 with a portion of a screen removed.
Figure 5:
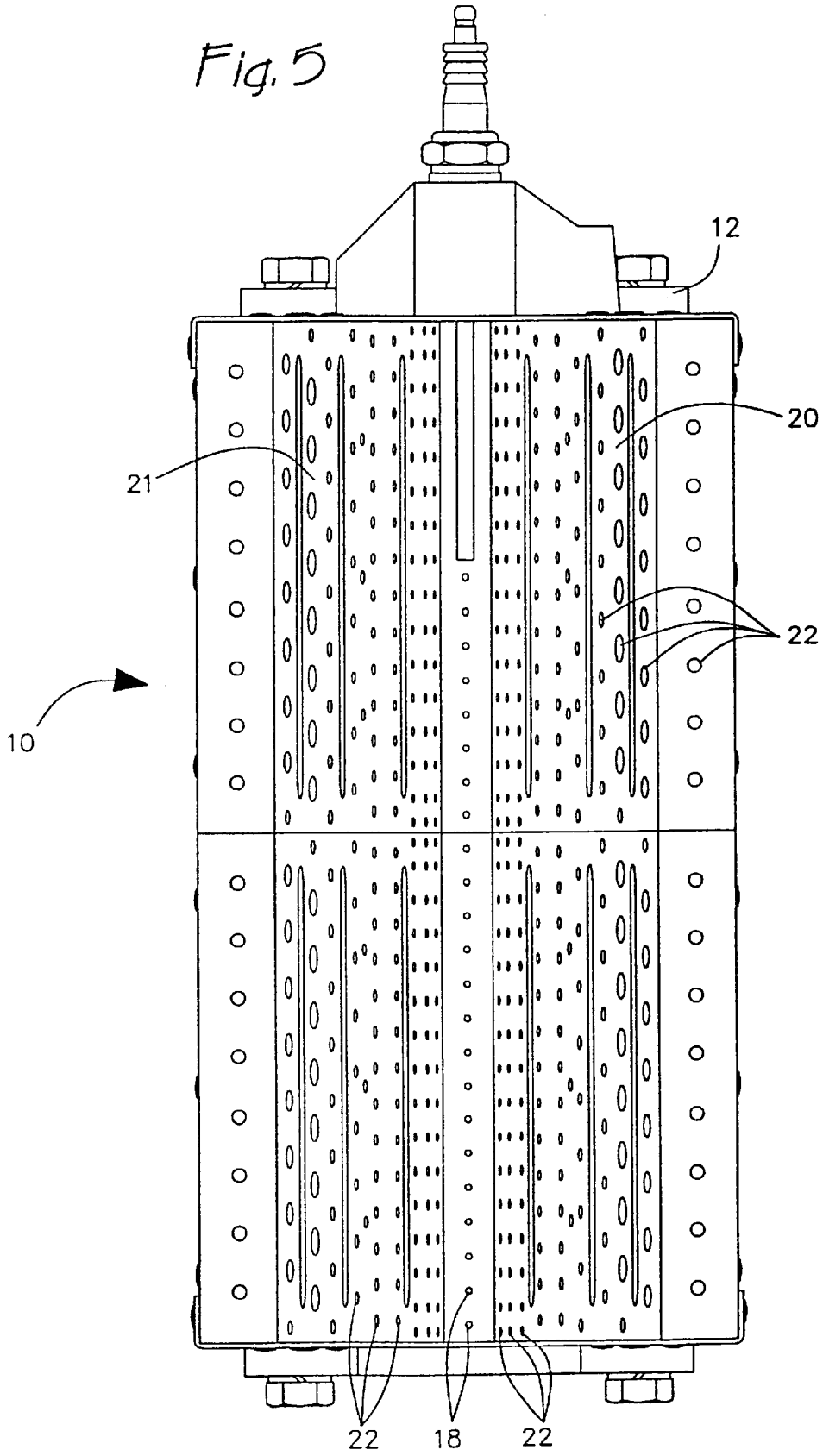
FIG. 5 is a front elevational view of the burner as taken along line 5—5 of FIG. 4.

Referring now to the drawings, FIGS. 1, 4, and 5 illustrate an air heating burner assembly 10 in accordance with the present invention. The burner assembly 10 includes a fuel manifold 12 which supports a pair of combustion air mixing plates 20, 21. The burner assembly 10 is placed inside an air flow, such as that provided through a duct. A portion of the air flow passes through the mixing plates 20, 21 and mixes with fuel exiting the fuel manifold 12 to produce a combustible mixture. The combustion heats the air flow to provide drying air for a wide variety of applications, such as powder coat curing, paint drying, and grain drying operations.

As best shown in FIG. 5, the fuel manifold 12 has a plurality of ports 18 for discharging fuel between the mixing plates 20, 21. The discharge ports 18 extend through a downstream face of the manifold and are positioned along the entire length of the burner. The manifold is connected to a fuel source (not shown) so that fuel flows from the source to the manifold and exits through the discharge ports 18.

Combustion air passes through the mixing plates 20, 21 to provide jets of combustion air for mixing with the fuel. As illustrated in FIGS. 1, 4, and 5, a plurality of combustion air ports 22 extend through each mixing plate 20, 21 to form the jets of air. According to the illustrated embodiment, the ports have a circular shape. It will be appreciated that the ports 22 may be formed in different shapes, such as slots or rectangles, in accordance with the present invention. In operation, the jets of combustion air mix with fuel exiting the discharge ports to create a combustible mixture. Combustion is initiated by an ignitor and directed downstream to provide heated air for drying or other operations.

As best shown in FIG. 1, the mixing plates 20, 21 form a general V-shape when viewed from above. The mixing plates 20, 21 generally diverge from one another as they extend downstream of the manifold 12. The V-shape allows fuel exiting the discharge ports 18 to freely disperse downstream of the manifold. Fluids such as fuel or air typically disperse at an angle of approximately 12–15° from the axis of flow. The fuel dispersion is illustrated in FIG. 1 by phantom lines 23, 24. The mixing plates 20, 21 are disposed at angles greater than approximately 15° to avoid interfering with fuel flow.

In the burner 10 as described above, the firing rate determines which combustion air ports 22 are used to form the combustible mixture. As best shown in FIGS. 1 and 5, the combustion air ports 22 are preferably aligned in rows, each row positioned a given distance downstream of the fuel manifold 12. The input or firing rate is reflected in the volume of fuel exiting the discharge ports 18. A small fuel volume results in a lower fuel velocity, and therefore the fuel reaches only the upstream ports 22 before mixing with air to form a combustible mixture. Mixing begins instantaneously and therefore combustion is localized about those ports. As fuel flow is increased, the velocity also increases to project fuel further downstream of the discharge ports 18. As a result, additional downstream combustion air ports 22 are utilized to create the combustible fuel-air mixture. Again, combustion is localized about the ports 22 and therefore combustion may take place along the entire length of the mixing plates 20, 21.

The above description helps illustrate the quenching problem typical of most conventional burners. As noted above, fuel flow velocity varies with the firing rate. The volume of combustion air, however, is kept constant so that air flow velocity is the same during low and high fire. At low fire, a relatively high proportion of excess air exists and air flow velocity is relatively high with respect to fuel flow velocity. The high air flow velocity reduces dwell time, resulting in a lower combustion temperature, i.e. the flame is quenched.

In light of the above, the present invention provides a pair of wings 25, 26 which are located upstream of and cover a portion of an associated mixing plate 20, 21. The wings provide an additional pressure drop which reduces air flow velocity therethrough, thereby eliminating the quenching problem during low to medium-low fire. The wings do not extend over the downstream portions of the mixing plates 20, 21 associated with medium to high fire, since quenching (and therefore CO emissions) do not appear to present a significant problem during such firing conditions.

In the preferred embodiment, the wings 25, 26 are disposed generally parallel to the associated mixing plates 20, 21, as best shown in FIG. 1. The wings 25, 26 have various sized air flow holes 28 extending therethrough. As a result, air passing through the air flow holes 28 experiences an initial pressure drop before reaching the mixing plates 20, 21, at which a second pressure drop exists. As a result, the velocity of air flowing through those ports is reduced, and CO emissions are kept under an acceptable level, such as approximately 400 ppm.

From the above, the preferred embodiment of the burner 10 may be described as having four zones, as best shown in FIG. 1. Zone I, indicated by reference numeral 30, is defined by the combustion air ports 22 located the farthest upstream on the mixing plates 20, 21. In the illustrated embodiment, the portions of the mixing plates 20, 21 in this zone are preferably parallel to one another rather than angled. The parallel mixing plate portions form a pocket in which the flame is protected from outside influences. In addition, the parallel portions produce perpendicular combustion air flow which results in better mixing of fuel and air in the zone. The wings 25, 26 overlap these portions of the mixing plates 20, 21, but do not have air flow holes 28 in the immediate area.

Zone II corresponds to upstream angled portions of the mixing plates 20, 21, and is identified by reference numeral 32. These portions of the mixing plates 20, 21 are covered by the wings 25, 26. Unlike for zone I, however, the portions of the wings 25, 26 associated with zone II have air flow holes 28 in the immediate area of the combustion air ports 22 in the mixing plates. The air flow holes 28 are preferably not aligned with the combustion air ports 22, since such an alignment would reduce the total pressure drop through that area of the burner.

Zone III (indicated by reference numeral 34) is defined by the next downstream portion of the mixing plates 20, 21. As best illustrated in FIG. 1, the mixing plates 20, 21 are angled with respect to one another, as in zone II. The portions of the mixing plates 20, 21 forming zone III, however, are not covered by the wings 25, 26.

Finally, zone IV, indicated by reference numeral 36, is defined by the combustion air ports 22 located the farthest downstream of the manifold 12. Similar to zone 1, the portions of the mixing plates 20, 21 making up zone IV extend directly downstream and are therefore substantially parallel to one another. The wings 25, 26 do not overlap these portions of the mixing plates. The parallel mixing plate portions create more intense mixing of the air with fuel and combustion products, thereby creating more complete combustion and reducing CO emissions. In addition, overall flame length is reduced during high fire, which reduces space requirements for the burner 10.

The combustion air ports 22 are sized and positioned to supply an acceptable level of excess air in each zone. Stated another way, each zone supplies a sufficient amount of combustion air to immediately obtain a combustible mixture at each zone. As a result, combustion is localized and immediate in each zone, rather than staged.

In addition to reducing air flow velocity, the wings 25, 26 form preheat chambers 38, 40 which serve to increase combustion temperature and thereby reduce CO emissions at low fire. The space between each wing and associated mixing plate holds a volume of air. The air is preheated by the mixing plate, thereby increasing the temperature of incoming combustion air. The amount of space between each wing and associated mixing plate directly affects the amount of heat transfer. It has been determined that the distance between each wing and associated mixing plate is preferably four times the diameter of the smallest air flow hole 28.

Figure 2:
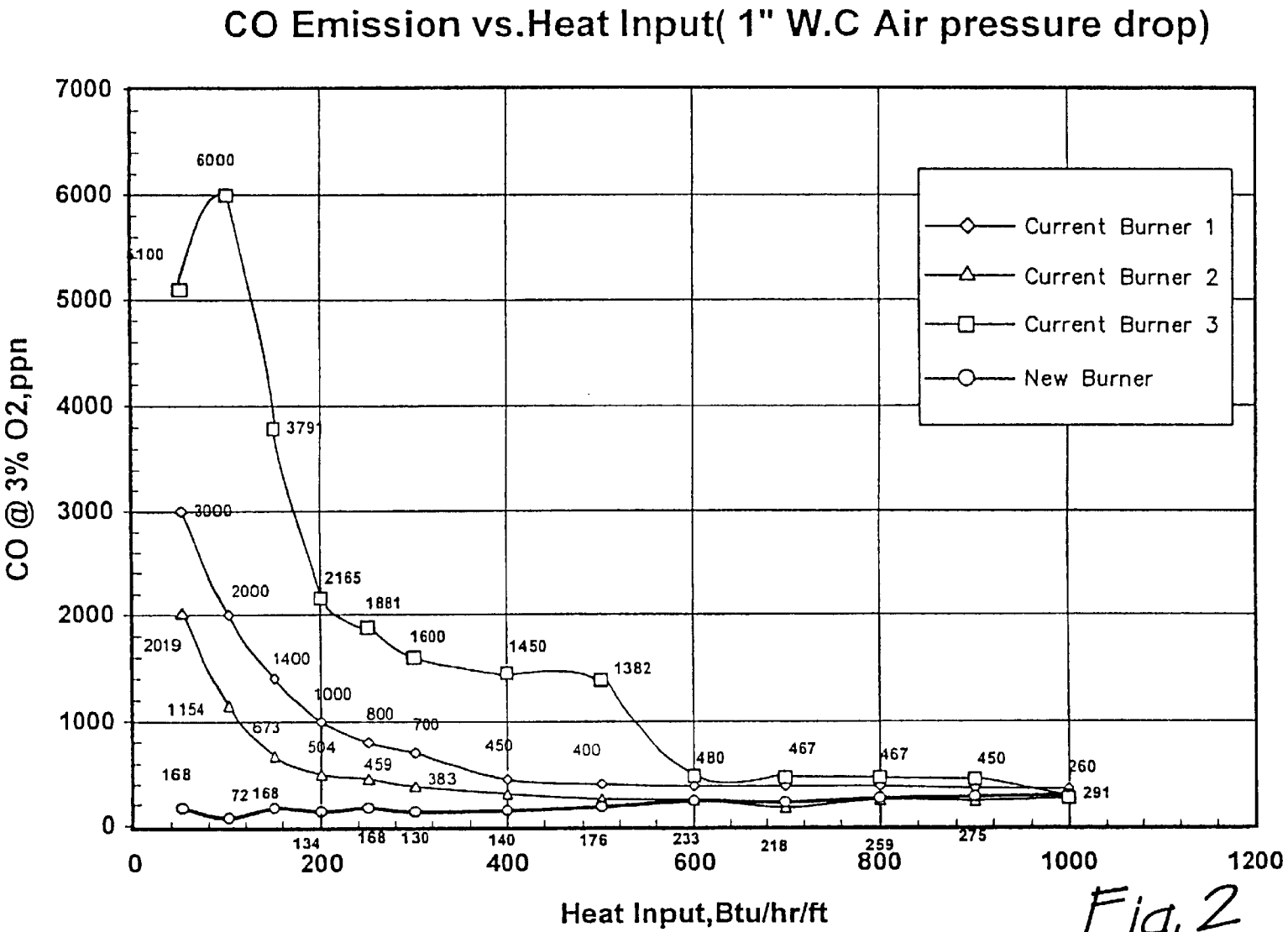
FIG. 2 is a graph showing the CO emissions generated by conventional air heating burners as compared to the burner of the present invention over a range of inputs.

Testing of the burner 10 has indicated significant improvement in CO emissions across a wide range of inputs. The performance of conventional air heating burners varies greatly over the range of heat inputs, as illustrated by the top three lines in the graph shown at FIG. 2. CO emission levels generated by conventional burners at low to medium-low inputs are overly high, often exceeding 1000 ppm (at 3% $O_2$). The burner 10 of the present invention, however, performs substantially consistently across the entire range of heat inputs. As shown in FIG. 2, the CO levels generated by the present burner 10 are safely below the 1000 ppm level across the entire range of inputs. In particular, CO emissions at low to medium-low fire are maintained well below the acceptable level, in contrast to the previous burners.

Figure 3:
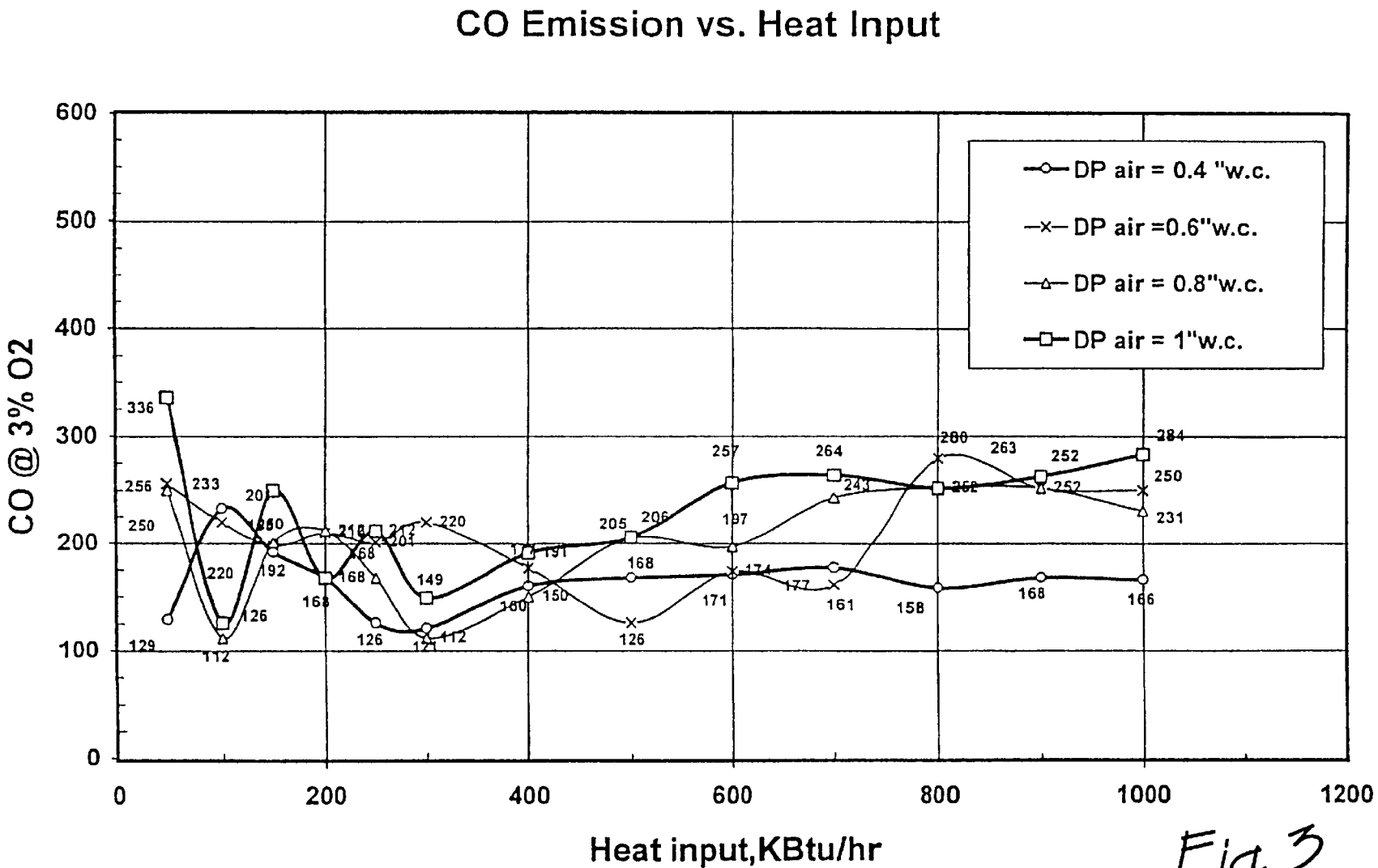
FIG. 3 is a graph showing CO emissions of the burner of the present invention over a range of pressure drops across the burner.

Furthermore, CO emissions by the present burner 10 are not greatly affected by changes in pressure drop across the burner. The graph at FIG. 3 illustrates CO emissions across a range of heat inputs for different pressure drops across the burner. It does not appear that a discernible trend is established in which CO emissions are directly related to pressure drop, other than that CO emissions are roughly the same regardless of the pressure drop. Regardless of pressure drop, CO levels are maintained below the 400 ppm level. Accordingly, unlike previous air heating burners, performance of the burner 10 of the present invention is largely unaffected by changes in pressure drop.

From the foregoing, it will be appreciated that the present invention brings to the art a new and improved air heating burner. The burner incorporates wings which reduce air flow velocity through the combustion air ports associated with low to medium-low fire. As a result, residence time in this area of the burner is increased at these inputs, resulting in an increased combustion temperature and reduced CO emissions. The burner of the present invention has relatively low and substantially consistent CO emissions across a broad range of heat inputs, regardless of the pressure drop across the burner.

What is claimed is:

1. An air heating burner adapted to be placed in an air flow, the air heating burner comprising:

an elongate fuel manifold having a plurality of discharge ports aligned along its length for discharging fuel downstream along a flow axis;

pair of mixing plates secured to the manifold on opposing sides of the flow axis, the mixing plates diverging from each other as the mixing plates extend downstream from the manifold, each mixing plate having a plurality of combustion air ports located at various distances downstream from the fuel manifold, the combustion air ports for mixing air flow with fuel flow to form a combustible air-fuel mixture between the mixing plates; and a pair of wings, one for each mixing plate, each wing covering a plurality of combustion air ports located in proximity to the manifold leaving combustion air ports downstream of the wings exposed, the wings spaced from their respective mixing plates to define a pair of chambers, the wings having a plurality of air flow holes for introducing air into the chambers, the air exiting the chambers at a location between the mixing plates beginning immediately downstream of the fuel manifold.

2. The air heating burner of claim 1, wherein the portions of the mixing plates covered by the wings correspond to a fire flame size in the range of low to medium-low fire, the air flow volume exiting the chambers being sufficient to complete 100% combustion at low to medium-low fire.

3. The air heating burner of claim 2, wherein the air flow holes in the wings provide a pressure drop that reduces the air flow velocity through the mixing plates, thereby reducing quenching of the flame at low to medium-low fire.

4. The air heating burner of claim 3, wherein the reduced air flow velocity restricts the CO emissions to an upper limit of approximately 400 ppm.

5. The air heating burner of claim 1, wherein the wings are sized and positioned to reduce the air flow velocity through the wing covered portions of the mixing plates to a level generally below fuel flow velocity of fuel exiting the manifold.

6. The air heating burner of claim 1, wherein the wings extend generally parallel to their respective mixing plates.

7. The air heating burner of claim 6, wherein the wings are spaced from their respective mixing plates a distance approximately four times the diameter of the smallest air flow hole.

8. The air heating burner of claim 1, wherein the plurality of combustion air ports are aligned in separate rows on each mixing plate, each row positioned a predetermined distance downstream from the fuel manifold for supplying a sufficient amount of air to immediately obtain a combustible air-fuel mixture at each row, thereby localizing combustion of the air-fuel mixture.

9. An air heating burner adapted to be placed in a process air flow, the air heating burner comprising:

an elongate fuel manifold having a plurality of discharge ports aligned along its length for discharging fuel downstream along a flow axis;

a pair of mixing plates secured to the manifold on opposing sides of the flow axis, the mixing plates diverging from each other as the mixing plates extend downstream from the manifold, each mixing plate having a plurality of combustion air ports for mixing air flow with fuel flow to form an air-fuel mixture between the mixing plates, the combustion air ports located at various distances downstream from the fuel manifold and sized to supply a sufficient amount of air to immediately obtain a combustible air-fuel mixture for localized combustion; and a pair of wings, one for each mixing plate, the wings attached to the mixing plates and spaced therefrom to define a pair of chambers proximate the manifold, the combustion air ports located downstream of the wings being exposed, the wings having a plurality of air flow holes for introducing air into the chambers, the air flow holes spanning an area overlapping the combustion air ports.

10. The air heating burner of claim 9, wherein the air flow holes are not in alignment with the combustion air ports.

11. The air heating burner of claim 9, wherein the wing covered portion of each mixing plate includes an upstream end extending generally parallel to the flow axis.

12. The air heating burner of claim 11, wherein the wings include upstream end portions corresponding to the upstream ends of the mixing plates, the upstream end portions of the wings having no air flow holes.

13. The air heating burner of claim 9, wherein the wings reduce the air flow velocity through the wing covered portions of the mixing plates to a level generally below fuel flow velocity of fuel exiting the manifold.

14. The air heating burner of claim 9, wherein the wings extend generally parallel to their respective mixing plates and are spaced therefrom a distance approximately four times the diameter of the smallest air flow hole.

15. The air heating burner of claim 9, wherein the wing covered portion of each mixing plate includes an upstream end extending generally parallel to the flow axis.

16. The air heating burner of claim 15, wherein the wings include upstream end portions corresponding to the upstream ends of the mixing plates, the upstream end portions of the wings having no air flow holes.

17. A method of reducing the CO emissions of an air heating burner having a fuel manifold for discharging fuel downstream between a pair of mixing plates and along a flow axis, the mixing plates having a plurality of combustion air ports for mixing an air flow with the fuel flow to form an air-fuel mixture that burns at a fire flame size in the range of low to high fire, the method comprising the steps of:

attaching a pair of wings, one for each mixing plate, to the mixing plates to define a pair of chambers proximate the manifold, the wings having a plurality of air flow holes for introducing air into the chambers and providing a pressure drop that reduces the air flow velocity through the mixing plates, the air of reduced velocity exiting the chambers at a location between the mixing plates beginning immediately downstream of the fuel manifold.

18. The method of claim 17, wherein the wings are attached to the portion of the mixing plates that correspond to a fire flame size in the range of low to medium-low fire.

19. The method of claim 17, wherein the wings reduce the air flow velocity through the wing covered portions of the mixing plates to a level generally below fuel flow velocity of fuel exiting the manifold.

20. An air heating burner adapted to be placed in an air flow, the air heating burner comprising:

an elongate fuel manifold having a plurality of discharge ports aligned along its length for discharging fuel downstream along a flow axis;

a pair of mixing plates secured to the manifold on opposing sides of the flow axis, the mixing plates diverging from each other as the mixing plates extend downstream from the manifold, each mixing plate having a plurality of combustion air ports located at various distances downstream from the fuel manifold, the combustion air ports for mixing air flow with fuel flow to form a combustible air-fuel mixture between the mixing plates; and a pair of wings, one for each mixing plate, each wing covering a plurality of combustion air ports located in proximity to the manifold leaving combustion air ports downstream of the wings exposed, the wings spaced from their respective mixing plates to define a pair of chambers, the wings having a plurality of air flow holes for introducing air into the chambers, the furthest upstream air flow holes being positioned downstream of the furthest upstream combustion air ports.

21. The air heating burner of claim 20, wherein the furthest upstream combustion air ports introduce air at a location between the mixing plates beginning substantially immediately downstream of the fuel manifold.

22. The air heating burner of claim 20, wherein the wings are spaced from their respective mixing plates an average distance approximately four times the diameter of the smallest air flow hole.

23. The air heating burner of claim 22, wherein the wings extend generally parallel to their respective mixing plates.

* * * * *